United States Patent [19]

Molenaar

[11] 4,114,306

[45] Sep. 19, 1978

[54] SPRING TOY

[76] Inventor: Lester V. Molenaar, Box 777, West Highway 40, Willmar, Minn. 56201

[21] Appl. No.: 733,199

[22] Filed: Oct. 18, 1976

[51] Int. Cl.[2] ..... A63H 33/00

[52] U.S. Cl. ..... 46/1 R

[58] Field of Search ..... 46/1 R; 267/61 R, 166, 267/167, 180; 272/8 N; 40/106.51

[56] References Cited

U.S. PATENT DOCUMENTS

| | | | |
|---|---|---|---|
| 1,626,497 | 4/1927 | Archipenko | 40/106.51 |
| 2,415,012 | 1/1947 | James | 46/1 R |
| 3,761,211 | 9/1973 | Parkinson | 425/133.5 |
| 3,815,886 | 6/1974 | Graham et al. | 267/180 |

*Primary Examiner*—Louis G. Mancene
*Assistant Examiner*—Robert P. Swiatek
*Attorney, Agent, or Firm*—Burd, Braddock & Bartz

[57] ABSTRACT

A coil spring toy having a continuous helical flexible band made of rigid plastic material. The band has generally rectangular transverse cross section having a width substantially greater than its thickness. First outer and second inner edge surfaces of the band are opposed to one another and generally parallel in the direction of the band thickness. The band is wound about a central axis to form a helical coil having a plurality of circular turns substantially equal in size and aligned with one another. In one form, the band has first and second side-by-side portions of contrasting colors. Each portion spans the length and width of the band. In a second form, a figure in outline form is selectively applied to the first outer edge surface to form a normal configuration on the outer cylindrical surface of the toy. Selective bending of the band selectively distorts the figure with respect to its normal configuration.

43 Claims, 7 Drawing Figures

SPRING TOY

BACKGROUND OF THE INVENTION

Toys designed to reach the toddler and pre-school market must be capable of producing excitement and amusement if they are to be successful. From a parental standpoint, toys for toddlers must be durable and safe, considering the relatively careless treatment they are likely to receive from small children. Further benefit is derived from toys having educational value.

One toy which has achieved long term and continuing success in the market has been a spring toy consisting of an elongate steel band wound in circular fashion to form a coil. Because the steel band is quite small in cross section, it is easily bendable and therefore the coil may be compressed into a circular cylinder or stretched to a length many times that of the cylinder, all with relatively minor application of bending force. The small band cross section further serves to minimize the damping quality in the coil, maximizing the tendency for vibrations generated in the coil to repeat themselves. These properties enable the coil, when placed at the top of a stairway or inclined plane and properly actuated, to continue movement down the stairway or inclined plane and thus appear to be walking under its own power. This provides much amusement and excitement and accounts in large part for the success of the steel coil as a toy.

There are, however, characteristics of the steel coil which make it less popular with thoughtful parents. Among these is a relatively low durability. Steel has a relatively high elastic bending modulus. In other words, more force is required to bend steel as opposed to other materials. For this reason the band which forms the steel coil must be quite small in cross section.

A further problem with steel is that as compared to other materials, the elastic limit, though high in itself, is relatively low compared to the bending modulus.

These properties inherent in steel reduce toy durability in that the band forming the steel coil must be extremely small in cross section. Because the band is small in cross section, elastic deformation is accomplished with relatively small force. However, plastic or permanent deformation is also accomplished with relatively minor application of force. Consequently small children are able to permanently deform the steel spring toy with relative ease. Once permanently deformed, the spring toy is useless as it is no longer able to expand and contract in symmetrical fashion so as to "walk" down a stairway or an inclined plane.

The steel coil poses a safety hazard. Because of the small size of the band and the ease with which it can be permanently deformed, the ends of the band can become bent outwardly from the remainder of the coil and form sharp points or edges which could seriously harm a child playing with the toy.

Moreover, the steel coil is costly and offers relatively little educational value. As the steel coil is one solid color, its appearance is not designed to add to the child's excitement and amusement when playing with the toy.

Other materials, as plastics, have been used to make coil springs and spring toys. These materials are one color and have not been used with configuration indicia coordinated with the spring structure.

SUMMARY OF THE INVENTION

The invention relates to a spring toy formed from an elongated flexible band made of rigid material. The band has a substantially rectangular transverse cross section and has a width substantially greater than its thickness. The band has first and second edge surfaces opposed to one another, generally parallel to one another and running in the direction of the band width.

To form the spring toy, the band is wound about a central axis substantially in a helical shape. The band is wound so that the edge surfaces are parallel to the central axis, the first edge surface being radially outward from the central axis with respect to the second edge surface. The coil includes a plurality of turns which are substantially equal in size, and in alignment, with one another.

The band is bendable in a direction parallel to the central axis. This enables contraction of the coil into substantially the shape of a right circular cylinder. The first edge surface then forms an outer cylindrical surface of the coil. The coil is expandable from the cylindrical shape to a length along the central axis greatly exceeding the cylindrical length.

The band is also bendable perpendicular to the central axis. This permits movement of the turns with respect to one another perpendicular to the central axis, and also rotation of the turns about the central axis with respect to one another.

In one form of spring toy according to the invention, the band includes a first portion and a second portion in side-by-side relationship to one another over the band thickness, each portion spanning the entire length and width of the band. These portions can be in contrasting colors.

In a second form of the spring toy, configuration outline or indicia is selectively applied to the first or outer edge surface. This configuration outline, when the coil is contracted into a cylinder, forms on the outer cylindrical surface a normal configuration. Selective bending of the band selectively distorts the configuration outline out of its normal configuration.

The features of the spring toy according to the first and second forms of the invention may be combined, providing a spring toy having first and second portions of contrasting colors, and further including a configuration outline selectively applied to the first edge surface.

The spring toy described is constructed of relatively inexpensive plastic. Plastic has a lower bending modulus than does steel, enabling the band forming the coil to have a significantly larger cross section and yet retain the elasticity shown in the prior steel coil. Like the steel coil, the spring toy constructed according to the invention is able to "walk" down a stairway or inclined plane.

Because of its greater cross section, the plastic spring toy provides much greater resistance to permanent or plastic deformation. For example, it has been found that digital bending applied to individual segments of the band of the plastic spring toy does not cause permanent deformation unless force significantly above that from an average adult is applied. On the other hand, a child applying force in the same digital method is able to quite easily deform the band of the prior steel coil.

The plastic spring toy is significantly safer than is the steel coil, especially with smaller children. The plastic spring toy has no sharp edges, and due to the difficulty in permanently bending the plastic spring toy, its ends are not formable into sharp points that can poke or otherwise injure children.

The division of the band into first and second portions of contrasting colors provides greater amusement and excitement than does the prior art steel coil which is only one color. A face, animal caricature, or other configuration outline applied to the first edge surface according to the second form of the invention offers additional fun and excitement. A child is able to fashion his own distortions and create "trick mirror" effects.

Imprinting of the configuration outline upon the first edge surface also provides educational value. The child playing with the spring toy is able to create desired design distortions with particular bending of the toy, and therefore relate specific types of bending with specific types of distortion. Further, due to the low damping quality of the spring toy, the child is able to produce rapid and repetitive vibratory movement within the coil of individual turns with respect to one another. Sufficiently rapid movement creates the illusion that the caricature or other indicia is moving under its own power. Thus, the toy enhances the child's ability to perceive the effects of persistence of vision in "blending" a series of individual movements into an image of fluid motion or a moving picture. This can be accomplished from the child's playing with the toy in his hands or his watching the spring toy as it "walks" down a stairway or an inclined plane.

DESCRIPTION OF PREFERRED EMBODIMENT

Figure 1:
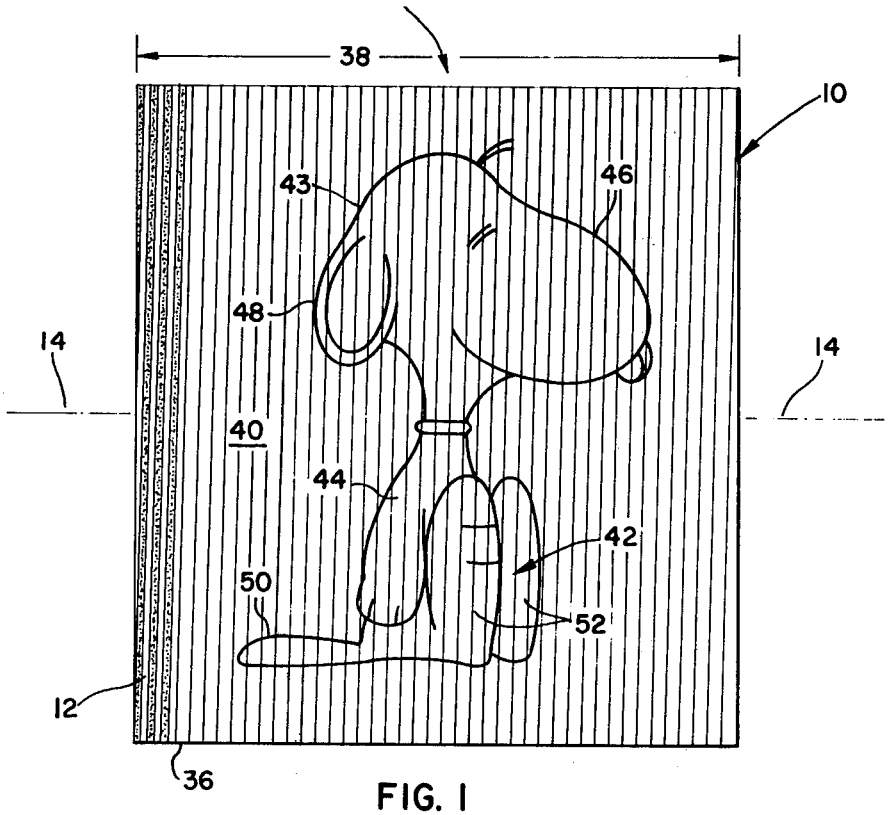
FIG. 1 is a side elevational view of a spring toy according to the present invention having a dog figure imprinted thereon.
Figure 2:
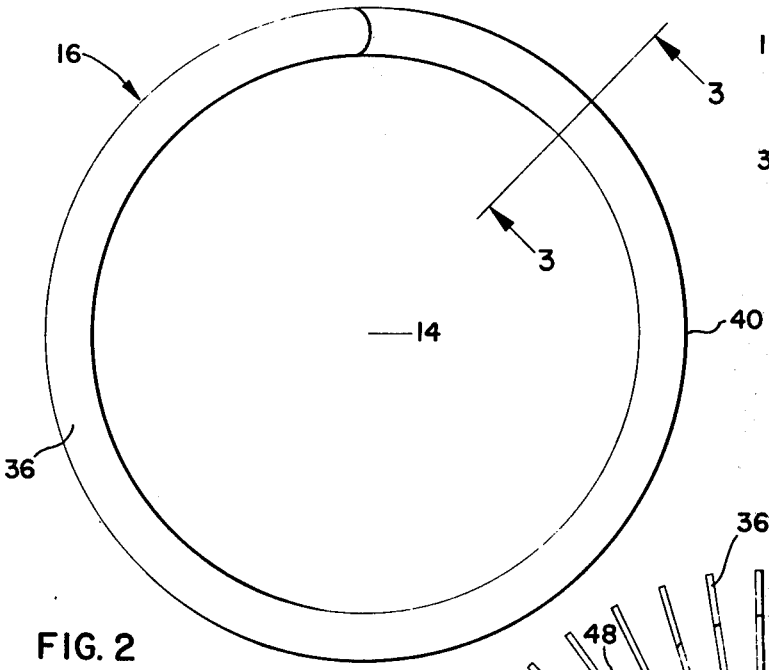
FIG. 2 is an elevation of one end of the spring toy.

Referring to the drawings, there is shown in FIGS. 1 and 2 at 10 a spring object or toy. Spring toy 10 comprises an elongated flexible band or ribbon product 12 wound about a central longitudinal axis 14 to form a coil 16 having the shape of a helix. Band 12 is preferably constructed of a dimensionally stable material having a low elastic bending modulus, high strength, and high resistance to plastic or permanent deformation, for example, a plastic. Band 12 herein is polyethylene, although other plastics and plastic type materials could readily be substituted. The properties inherent in plastic materials particularly suitable for construction of band 12 are a relatively low elastic bending modulus and a high ratio of elastic bending limit compared to elastic bending modulus. Elastic bending modulus relates to the force required to elastically deform an object a desired amount, while elastic bending limit can be defined as the greatest stress which can be applied without resulting in any permanent deformation.

A comparison with steel illustrates the advantages of the above two properties. Since steel has a much larger bending modulus, a steel band of the same size and subjected to the same force as a plastic band would undergo far less elastic deformation. Thus a steel band, in order to have elastic bending properties similar to plastic band 12, must have a much smaller cross section. As in the case of elastic bending modulus, the elastic limit for plastic is significantly smaller than that for steel. However, the ratio of elastic limit over elastic modulus is significantly higher for plastic than it is for steel. Consequently, given a plastic band 12 and a steel band having an equal elastic bending modulus, plastic band 12 more effectively resists permanent deformation.

Thus, spring toy 10, as opposed to a coil of steel having the same elastic properties, is far more durable. For example, if a portion of band 12 is isolated and subjected to a bending force applied digitally, elastic deformation will occur. However, severe plastic deformation or "kinking" will not occur unless an extreme amount of digital force is applied by an adult. In contrast, the steel band of similar elastic properties is quite easily permanently and severely bent or kinked.

Coil 16 of a plastic material is also safer than a steel coil having similar elastic properties. Kinking of the steel coil close to either end of the steel band would cause a sharp edge or point to extend from the coil which could poke or otherwise injure a child playing with it. Coil 16 of plastic material, on the other hand, more effectively resists kinking at the ends and throughout the coil. Even if an end of band 12 were bent outwardly with respect to the remainder of coil 16, it would not present a sharp point or cutting edge capable of causing injury.

Figure 3:
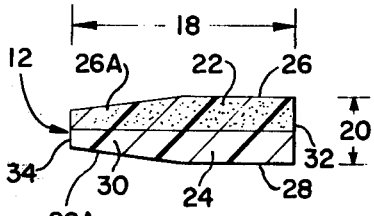
FIG. 3 is an enlarged sectional view taken along the line 3—3 of FIG. 2 with parts removed for illustration purposes.

Band 12 is shown in cross section at FIG. 3. In the preferred form of spring toy 10, band 12 has a generally uniform and generally rectangular cross section throughout its length. Band 12 has a width 18 and a thickness 20. Width 18 is a radial dimension length. Thickness 20 is an axial dimension normally parallel to the central longitudinal axis 14 of toy 10. Band 12 has a first portion 22 and a second portion 24 located in radial side-by-side positions. First portion 22 occupies the entire length and width 18 of the band and extends through a portion of band thickness 20. The remainder of band thickness 20 is occupied by second portion 24, which, similar to first portion 22, extends across the entire band length and width. While band 12 is homogeneous, portions 22 and 24 are distinguishable in that they are of contrasting color. For example, portion 22 can be red and portion 24 can be yellow. Other colors can be used to identify portions 22 and 24. Portions 22 and 24 give coil 16 a striped appearance represented in FIGS. 1, 4, 5 and 6 by alternating white and shaded or speckled bands at the left end. The striped appearance continues across the entire coil. However, the shading is discontinued beyond the left end in order to enhance illustration of other features of the invention.

Width 18 is preferably substantially greater than thickness 20. A width of approximately 5.5 mm. and a thickness of 2 mm. have been found satisfactory.

A first flat surface 26 extends across the majority of width 18 of band 12. A second flat surface 28 also extends across the majority of the band width and is parallel and opposed to first flat surface 26. Flat surfaces 26 and 28 extend over a substantially equal portion of width 18. Occupying the remainder of the band width is a tapered portion 30 having outside surfaces 26A and 28A, wherein the band thickness is reduced from 2 mm. to 1.5 mm. Both first portion 22 and second portion 24 are tapered. The function of tapered portion 30 will be later explained.

A first outside edge surface 32 is generally perpendicular to flat surfaces 26 and 28. First edge surface 32 spans thickness 20 of the band 12. A second inside edge surface 34 is parallel and opposed to first edge surface 32.

Coil 16 is formed by the winding of band 12 concentrically about central axis 14 such that edge surfaces 32 and 34 are parallel to central axis 14, with first edge surface 32 radially outward with respect to second edge surface 34. Coil 16 has a plurality of turns or 360° segments 36. As an example, a coil 16 having approximately 40 turns has been found to be satisfactory. The number of turns can vary to make a spring toy 10. A method and apparatus for making two color plastic coil spring toy 10 is disclosed in U.S. patent application Ser. No. 730,801, filed Oct. 8, 1976, now U.S. Pat. No. 4,074,958.

Due to the low bending modulus of spring toy 10, a relatively small application of force will cause elastic bending in band 12. For example, elastic bending in a direction parallel to central axis 14 enables contraction of coil 16 into the shape of a right circular cylinder, with adjacent turns 36 in contact with one another. In the cylindrical configuration, an axial length 38 is substantially equal to the thickness 20 of band 12 times the number of turns 36. In this configuration, first edge surface 32 defines an outer cylindrical surface 40 in coil 16. The cylindrical configuration is shown in FIG. 1.

Due to the low bending modulus, band 12 is readily bendable to reduce coil 16 into the cylindrical shape with minimal application of bending force. Spring toy 10 as described, with one end placed upon a generally level surface, conforms to the cylindrical configuration under the weight of band 12 without application of external force.

Figure 6:
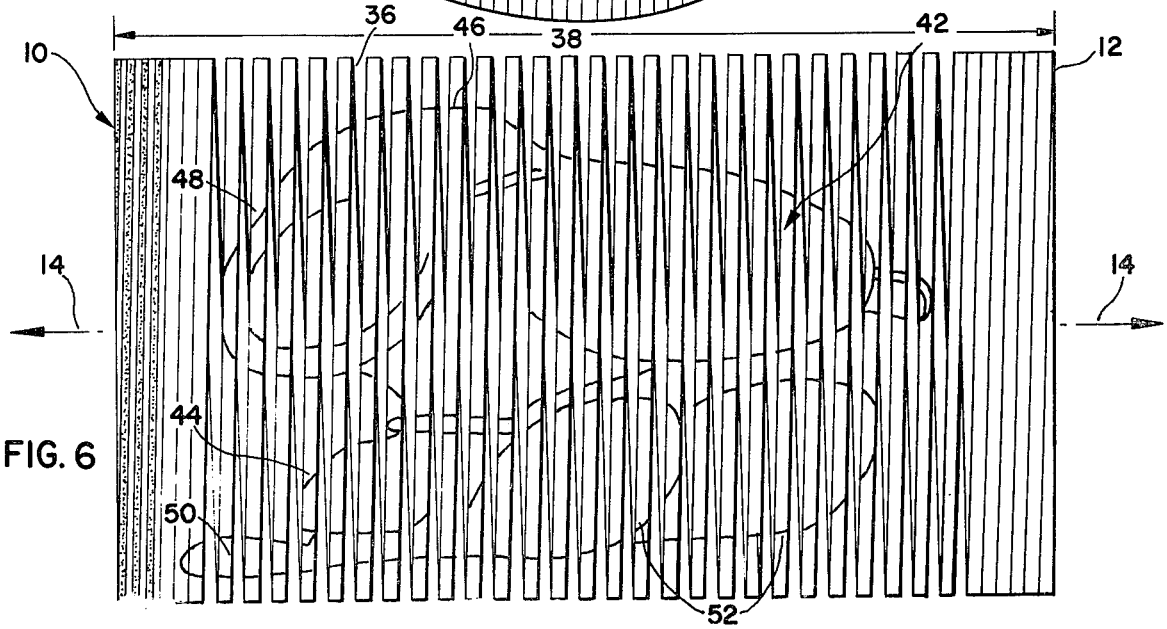
FIG. 6 is a side elevation of the spring toy in which the spring toy has been expanded to distort the dog figure.

Further elastic bending permits expansion of band 12 in the direction parallel to central axis 14. Coil 16 can assume an axial length 38 far greater than that of contracted coil 16. For example, spring toy 10 shown is expandable to an axial length 38 exceeding ten times the contracted length of coil 16 as a cylinder. Expansion of the length of coil 16 beyond the length of cylindrical shape is shown in FIG. 6.

Coil 16 is further elastically bendable in directions perpendicular to central axis 14. Such flexibility permits adjacent turns 36 to be moved with respect to one another perpendicular to central axis 14. With coil 16 in its cylindrical configuration, such movement consists of sliding of adjacent turns 36 with respect to one another. Also permitted is the rotation of adjacent turns 36, relative to one another and about central axis 14.

A figure indicated generally at 42, shown as a 1918 dog configuration, appears on outer cylindrical surface 40. The dog configuration includes a body at 44, a head 46, an ear 48, a tail 50 and feet 52. Figure 42 is a line 43 of paint, ink, colored plastic material secured or applied directly to the outer surface 32 of adjacent bands 12. Since the bands 12 are normally located in a stacked side-by-side location, line 43 comprises a series of short blocks or segments. Line 43 can be black or one or more colors that contrast with the colors of band 14. Surface 32 can be provided with a groove to form line 43. The walls of the groove can be colored to emphasize the line. Line 43 can be a rib or bead. The bead can have a color that contrasts with the color of the bands. Outer edge surface 32 is selectively illustrated such that dog figure 42 appears whenever the coil 16 is condensed into its cylindrical shape. Dog figure 42 is shown in an unstressed or normal configuration, formed whenever the only forces present are acting parallel to central axis 14 in maintaining coil 16 in the cylindrical configuration. FIG. 42 may be an animal caricature, as a horse, tiger, moose, mouse, bear, pink panther, the face of a clown, human shape, or a repeating or geometric pattern. Preferably, the design is interesting to the child playing with spring toy 10, and is susceptible to amusing disfigurations from the normal configuration as will be explained.

By elastically bending band 12, design figure 42 may be selectively distorted from its normal configuration of FIG. 1. Selective distortions are shown in FIGS. 4 through 7.

Figure 4:
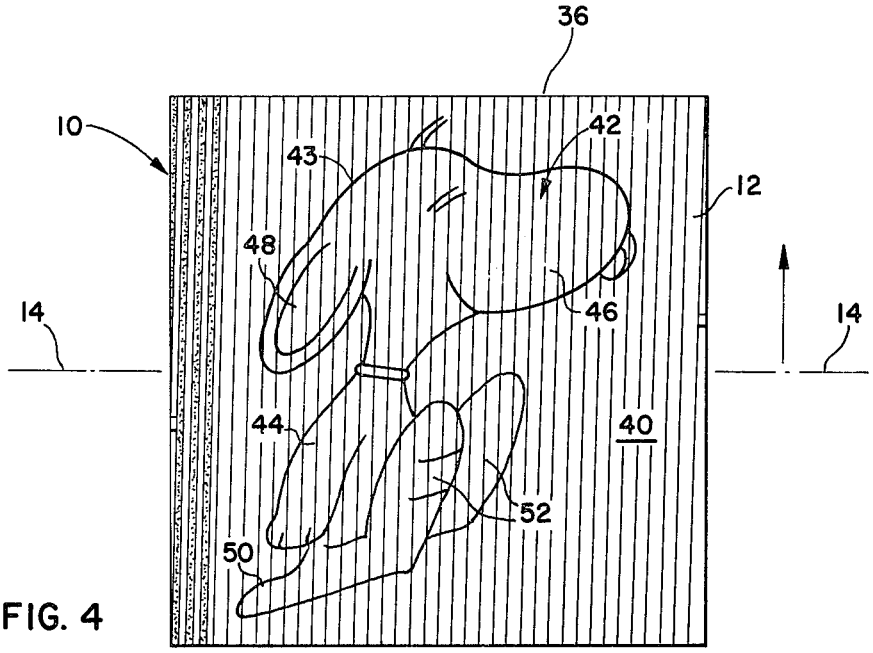
FIG. 4 is a side elevation showing the spring toy twisted to distort the dog figure.

In FIG. 4, spring toy 10 remains in the cylindrical configuration. However, one end of coil 16 is twisted with respect to the opposite end. This produces a rotation in each turn 36 about central axis 14 with respect to its adjacent turns 36. This twisting is shown in FIG. 4 as a relative movement in a forward face of each turn with respect to the forward faces of neighboring turns: upward with respect to turn 36 to the left, and downward with respect to turn 36 to the right. This produces the overall distortion of figure 42 shown, in which the rightward portions of the figure are turned upward with respect to the normal configuration, while the leftward portions of figure 42 are turned downward with respect to the normal configuration.

Figure 5:
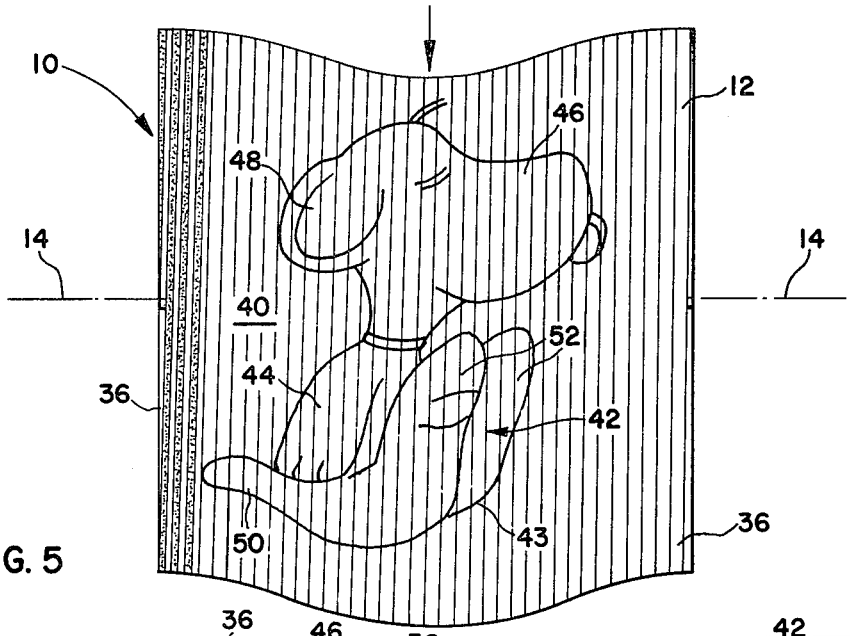
FIG. 5 is a side elevation of the spring toy in which portions of the spring toy are slidably moved in relation to the remainder thereof to distort the dog figure.

Application of a uni-directional force perpendicular to central axis 14 causes a sliding movement of each turn 36 with respect to its neighboring turns. With coil 16 as a cylinder, such a sliding movement, absent rotation, produces an oblique bending or bulging deviation from the cylindrical configuration as is shown in FIG. 5. Figure 42 is correspondly bent or bulged out of the normal configuration.

FIG. 6 shows elongation of coil 16 by the elastic bending of band 12 parallel to central axis 14 as described above. Elongation of coil 16 produces an accompanying elongation in figure 42 as shown in FIG. 6.

Figure 7:
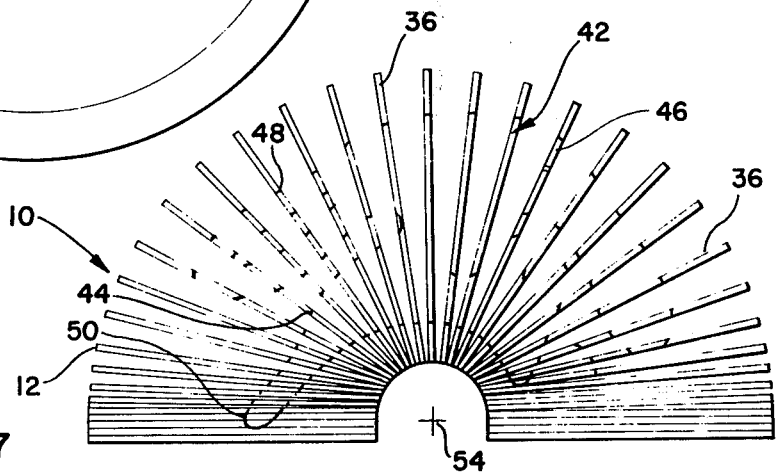
FIG. 7 is a side elevation of the spring toy in which the spring toy has been arcuately expanded to a semicircular configuration to arcuately distort the dog figure.

In FIG. 7, coil 16 is expanded and bent such that the two end turns are parallel to one another and occupy substantially the same plane. Coil 16 is bent about an axis shown at 54. This involves bending of band 12 in a direction parallel to central axis 14. Said bending, however, is not equal throughout the cross sectional width 18 of band 12, since portions of coil 16 relatively further removed from axis 54 must undergo relatively greater bending. This difference is most pronounced in the portion of coil 16 nearest axis 54, where the nearest part of first edge surface 32 experiences virtually no bending from the cylindrical configuration while the corresponding part of second edge surface 34 is spaced from adjacent turns 36, requiring bending in each turn 36. In other words, steadily increased bending is required from first edge surface 32 to second edge surface 34. The distortion resulting from this variance in bending is minimized due to tapered portion 30. As second edge surface 34 is thinner than first edge surface 32, it offers comparatively less resistance to bending in the direction parallel to central axis 14. Thus, while the elastic bending modulus remains constant, the tapered portion 30 provides for a steadily decreasing resistance to elastic bending in band 12. For this reason, coil 16 can remain in the configuration shown in FIG. 7 with the application of no force than the weight of band 12 itself.

Bending of coil 16 into the shape shown in FIG. 7 produces the distortion of figure 42 shown, the top of design figure 42 undergoing greater expansion than the bottom.

It is understood that the discreet methods of bending coil 16 illustrated in FIGS. 4 through 7 may be practiced not only individually but in selected combinations with one another. Figure 42 may therefore be selectively distorted in a variety of configurations apart from the normal configuration which involve combinations of the distortions shown in FIGS. 4 through 7.

While FIGS. 4 through 7 illustrate selected static bending of coil 16 from its cylindrical shape, producing selected static distortions of figure 42 from its normal configuration, these figures convey only in part the utility of spring toy 10. Substantial enjoyment and educational value is derived from kinetic use of spring toy 10. This can involve either oscillation of spring coil 16 or simply the relatively slower movement of turns 36 with respect to one another as coil 16 is moved from one configuration such as the cylindrical shape, to a second configuration such as one of those illustrated in FIGS. 4 through 7.

For example, a child playing with spring toy 10 can twist coil 16 in a clockwise direction and distort figure 42 from the normal configuration to a configuration similar to that shown in FIG. 4. While the twisting is in progress, the child feels through his hands and fingers the rotational force hs is imparting to coil 16. Simultaneously, he views the rising of the dog's nose and the lowering of the dog's ears and tail. These distortions of figure 42 are visual manifestations of the child's twisting of coil 16. Thus the child is provided with an opportunity to relate the physical manipulation of band 12 with the more abstract distortion of an image, namely figure 42. Similar opportunities for relating physical distortion of coil 16 with abstract disfiguration of figure 42 are provided with the various selective bendings of band 12.

The low bending modulus of band 12 and a characteristically low damping quality of coil 16 result in comparative longevity of repetition of vibrations introduced into coil 16 when the same is expanded as in FIG. 6. This enables coil 16, when properly actuated atop an inclined plane or a stairway, to travel end over end down the inclined plane or stairway and thus appear to be "walking" under its own power. Furthermore, a child can introduce a series of vibrations into coil 16 by holding it in the position shown in FIG. 7 with one end in each hand, and then moving his hands slightly upward and then downward with respect to one another. In either of the above movement forms, the illusion is produced of an individual turn 36 traveling from one end of coil 16 to the other. Close scrutiny of coil 16 of course reveals that the image of a turn 36 moving from one end to the other is actually the vibratory motion imparted from each turn 36 to the next adjacent turn 36.

Images created by vibration in coil 16 take on added significance when the effect upon figure 42 is considered. When vibrations are introduced into coil 16, design figure 42 is transformed into a moving image. What appears to be fluent image is, of course, merely the vibratory motion transformed from each turn 36 to the next subsequent turn 36. Correspondingly, motion is transferred from each forward face to the next adjacent forward face, each forward face carrying a portion of figure 42. The child playing with spring toy 10 and imparting vibrations thereto is thus given the opportunity to relate the physical vibration of coil 16 to the image of design 42 in apparently fluid motion. Thus the concept of creating the illusion of fluid motion through a series of distinct but sufficiently brief and closely timed individual movements can be introduced to the child through spring toy 10.

While the specific embodiment of the invention is a band wound to form a helix, it is recognized that minor changes in structure and materials fall within the scope of the invention. For example, the toy can have a square, hexagonal or octagonal shape. Figure 42 can be repeated on the opposite side of the toy.

The embodiments of the invention in which an exclusive property or privilege is claimed are defined as follows:

1. A spring toy comprising: an elongated flexible band of rigid material having a generally rectangular cross section and a width substantially greater than its thickness; said band having first and second edge surfaces opposed to one another and generally parallel in the direction of the band thickness; said band disposed about a central axis to form a coil having a plurality of repetitive turns substantially equal in size and aligned with one another, wherein the first and second edge surfaces are parallel to the central axis, said first edge surface radially being located outward with respect to the second edge surface; said band includes first and second flat surfaces opposed to one another and perpendicular to the edge surfaces, said flat surfaces originating at the first edge surface and extending across a portion of the band width; and two outside surfaces, each outside surface extending from a flat surface to the second edge surface, at least one of said outside surfaces being angularly disposed with respect to its adjacent flat surface to define in the band a tapered portion converging to the second edge surface; said band bendable parallel to the central axis enabling contraction of the coil wherein adjacent turns are in surface contact with one another and the first edge surface defines a co-extensive outer surface of the coil and further bendable to enable expansion of the coil to an axial length greatly exceeding that of the contracted coil; said band bendable in directions perpendicular to the central axis such that turns are movable in said directions and rotatable about the cenral axis with respect to one another; and means on portions of the first edge surface of at least some of the turns to provide a normal visual configuration, said configuration being distorted with respect to its normal configuration by selectively bending the band.

2. The spring toy of claim 1 wherein: the means providing the visual configuration is a line on parts of the outer surface of some of the turns.

3. The spring toy in claim 1 wherein: the turns are circular to define the coil as helical in shape.

4. The spring toy of claim 1 wherein: the coil has at least 30 turns.

5. The spring toy of claim 1 wherein: said band includes first and second portions of contrasting colors, each portion spanning the length and width of the band and spanning part of the band thickness.

6. The spring toy of claim 1 wherein: both outside surfaces are angular with respect to their associated flat surfaces and converge symmetrically to the second edge surface.

7. The spring toy of claim 6 wherein: the tapered portion occupies approximately one-third of the band width.

8. The spring toy of claim 1 formed of a material having a low elastic banding modulus and a high resistance to permanent deformation.

9. The spring toy of claim 8 formed of plastic.

10. The spring toy of claim 1 wherein: said band comprises first and second portions of contrasting colors, each portion being colored plastic material spanning the length and width of the band and spanning part of the band thickness.

11. A spring toy comprising: an elongate flexible band of generally rectangular cross section having a width substantially greater than its thickness; said band having first and second edge surfaces opposed to one another and generally parallel in the direction of the band thickness; said band including first and second portions of contrasting colors, each portion spanning the length and width of the band and spanning part of the band thickness; said band disposed about a central axis to form a coil having a plurality of repetitive turns substantially equal in size and aligned with one another, wherein the edge surfaces are parallel to the central axis and the first edge surface is radially outward with respect to the second edge surface; said band bendable parallel to the central axis enabling contraction of the coil wherein adjacent turns are in surface contact with one another and the first edge surface defines a continuous outer surface of the coil, and further bendable to enable expansion of the coil to an axial length greatly exceeding that of the contracted coil; and said band bendable in direction perpendicular to the central axis such that the turns are movable in said directions and rotatable about the central axis with respect to one another.

12. The spring toy of claim 11 wherein: the turns are circular to define the coil as helical in shape.

13. The spring toy of claim 11 wherein: the coil includes at least 30 turns.

14. A spring toy comprising: an elongated flexible band of generally rectangular cross section having a width substantially greater than its thickness; said band having first and second edge surfaces opposed to one another and generally parallel in the direction of the band thickness; said band including first and second portions of contrasting colors, each portion spanning the length and width of the band and spanning part of the band thickness; said band including first and second flat surfaces opposed to one another and perpendicular to the edge surfaces, the flat surfaces originating at the first edge surface and extending across at least a portion of the band width, and two outside surfaces, each outside surface extending from a flat surface to the second edge surface, at least one of said outside surfaces being angularly disposed with respect to its associated flat surface to define in the band a tapered portion converging to the second edge surface; said band disposed about a central axis to form a coil having a plurality of repetitive turns substantially equal in size and aligned with one another, wherein the edge surfaces are parallel to the central axis and the first edge surface is radially outward with respect to the second edge surface; said band bendable parallel to the central axis enabling contraction of the coil wherein adjacent turns are in surface contact with one another and the first edge surface defines a continuous outer surface of the coil, and further bendable to enable expansion of the coil to an axial length greatly exceeding that of the contracted coil; and said band bendable in directions perpendicular to the central axis such that the turns are movable in said directions and rotatable about the central axis with respect to one another.

15. The spring toy of claim 14 wherein: both outside surfaces are angular with respect to their associated flat surfaces and symmetrically converge to the second edge surface.

16. The spring toy of claim 15 wherein: the tapered portion occupies approximately one-third of the band width.

17. The spring toy of claim 14 formed of a material having a low elastic bending modulus and a high resistance to permanent deformation.

18. The spring toy of claim 17 is formed of plastic.

19. The spring toy of claim 14 wherein: the first and second portions of the band are contrasting colored plastic.

20. The spring toy of claim 14 including: means on portions of the first edge surface of at least some of the turns to provide a visual configuration.

21. The spring toy of claim 20 wherein: said means of claim 20 includes lines on parts of the outer surface of some of the turns.

22. A spring toy comprising: an elongate flexible band of substantially rectangular cross section having a width substantially greater than its thickness; said band including first and second portions of contrasting colors, each portion spanning the length and width of the band and spanning part of the band thickness; said band including first and second edge surfaces opposed to one another and generally parallel in the direction of the band thickness; said band disposed about a central axis to form a coil having a plurality of repetitive turns substantially equal in size and aligned with one another, wherein the edge surfaces are parallel to the central axis and the first edge surface is radially outward with respect to the second edge surface; said band bendable parallel to the central axis enabling contraction of the coil wherein adjacent turns are in surface contact with one another and the first edge surface defines a continuous outer surface of the coil, and further bendable to enable expansion of the coil to an axial length greatly exceeding that of the contracted coil; said band bendable in directions perpendicular to the central axis such that the turns are movable in said directions and rotatable about the central axis with respect to one another; and means on portions of the first edge surface of at least some of the turns to provide a normal visual configuration, said configuration being distorted with respect to its normal configuration by selectively bending the band.

23. The spring toy of claim 22 wherein: the turns are circular, defining the coil as helical in shape.

24. The spring toy of Claim 22 wherein: the coil has at least 30 turns.

25. The spring toy of claim 22 wherein: the band is formed of a material having a low elastic bending modulus and a high resistance to permanent deformation.

26. The spring toy of claim 25 wherein: the material is plastic of two different colors.

27. The spring toy of claim 22 wherein: the means providing the visual configuration includes lines on parts of the outer surface of some of the turns.

28. A spring toy comprising: an elongated flexible band of substantially rectangular cross section having a width substantially greater than its thickness; said band including first and second portions of contrasting colors, each portion spanning the length and width of the band and spanning part of the band thickness; said band including first and second edge surfaces opposed to one another and generally parallel in the direction of the band thickness; said band including first and second flat surfaces opposed to one another, perpendicular to the edge surfaces, and originating at the first edge surface and extending across a portion of the band width; and two outside surfaces, one extending from each flat surface to the second edge surface, at least one of said outside surfaces angular with respect to its associated flat surface to define in the band a tapered portion converging to the second edge surface; said band disposed about a central axis to form a coil having a plurality of repetitive turns substantially equal in size and aligned with one another, wherein the edge surfaces are parallel to the central axis and the first edge surface is radially outward with respect to the second edge surface; said band bendable parallel to the central axis enabling contraction of the coil wherein adjacent turns are in surface contact with one another and the first edge surface defines a continuous outer surface of the coil, and further bendable to enable expansion of the coil to an axial length greatly exceeding that of the contracted coil; said band bendable in directions perpendicular to the central axis such that the turns are movable in said directions and rotatable about the central axis with respect to one another; and means on portions of the first edge surface of at least some of the turns to provide a normal visual configuration, said configuration being distorted with respect to its normal configuration by selectively bending the band.

29. The spring toy of claim 28 wherein: both outside surfaces are angular with respect to their associated flat surfaces and converge symmetrically to the second edge surface.

30. The spring toy of claim 29 wherein: the tapered portion occupies approximately one-third of the band width.

31. The spring toy of claim 28 wherein: the band is formed of a material having a low elastic bending modulus and a high resistance to permanent deformation.

32. The spring toy of claim 31 wherein: the material is plastic.

33. The spring toy of claim 28 wherein: the means providing the visual configuration is a line on parts of the outer surface of some of the turns.

34. A spring toy comprising: an elongated flexible band having an outside edge surface extended generally parallel in the direction of the band thickness; said band disposed about a central axis to form a coil having an inside edge surface and a plurality of repetitive turns substantially equal in size and aligned with one another, wherein the outside edge surface is parallel to the central axis, said band having first and second flat surfaces opposed to one another and perpendicular to the outside edge surface, said flat surfaces originating at the outside edge surface and extending across a portion of the band width; and two outside surfaces, each outside surface extending from the inside edge surface, at least one of said outside surfaces being angularly disposed to its adjacent flat surface to define in the band a tapered portion converging to the inside edge surface, and visual means on portions of the outside edge surface of at least some of the turns to provide a normal visual configuration, said configuration being distorted with respect to its normal configuration by selectively bending the band.

35. The spring toy of claim 34 wherein: the visual means providing the visual configuration includes lines on parts of the outside edge surface of some of the turns.

36. The spring toy in claim 34 wherein: the turns are circular to defined the coil as helical in shape.

37. The spring toy of claim 34 wherein: both outside surfaces are angular with respect to their associated flat surfaces and converge symmetrically to the inside edge surface.

38. The spring toy of claim 37 wherein: the tapered portion occupies approximately one-third of the band width.

39. The spring toy of claim 34 formed of a material having a low elastic bending modulus and a high resistance to permanent deformation.

40. The spring toy of claim 39 formed of plastic.

41. A spring toy comprising: an elongated flexible band having an outside edge surface extended generally parallel in direction of the band thickness, said band including first and second portions of contrasting colors, each portion spanning the length and width of the band the spanning part of the band thickness, said band disposed about a central axis to form a coil having a plurality of repetitive turns substantially equal in size and aligned with one another, wherein the outside edge surface is parallel to the central axis, and the visual means on portions of the outside edge surfaces of at least some of the turns to provide a normal visual configuration, said configuration being distorted with respect to its normal configuration by selectively bending the band.

42. The spring toy of claim 41 wherein: each of said portions are contrasting colored plastic.

43. The spring toy of claim 41 wherein: the band has a generally rectangular cross section and a width substantially greater than its thickness.

* * * * *

UNITED STATES PATENT AND TRADEMARK OFFICE

CERTIFICATE OF CORRECTION

PATENT NO. : 4,114,306

DATED : September 19, 1978

INVENTOR(S) : Lester V. Molenaar

It is certified that error appears in the above-identified patent and that said Letters Patent are hereby corrected as shown below:

Column 6, line 41, "correspondly" should be -- correspondingly --.

Column 9, line 5, "banding" should be -- bending --.

Column 12, line 20, "defined" should be -- define --.

Column 12, line 37, "the" (1st occurrence) should be -- and --.

Signed and Sealed this

*Fourteenth* Day of *November 1978*

[SEAL]

*Attest:*

RUTH C. MASON
*Attesting Officer*

DONALD W. BANNER
*Commissioner of Patents and Trademarks*